US009825407B2

(12) United States Patent
Wu et al.

(10) Patent No.: US 9,825,407 B2
(45) Date of Patent: Nov. 21, 2017

(54) CABLE CONNECTOR ASSEMBLY HAVING IMPROVED METAL SHELL

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/196,450

(22) Filed: Jun. 29, 2016

(65) Prior Publication Data

US 2016/0380387 A1 Dec. 29, 2016

(30) Foreign Application Priority Data

Jun. 29, 2015 (CN) ..... 2015 2 0451759

(51) Int. Cl.

| | |
|---|---|
| ***H01R 12/53*** | (2011.01) |
| ***H01R 13/6581*** | (2011.01) |
| ***H01R 24/60*** | (2011.01) |
| ***H01R 13/66*** | (2006.01) |
| *H01R 107/00* | (2006.01) |

(52) U.S. Cl.

CPC ..... *H01R 13/6581* (2013.01); *H01R 12/53* (2013.01); *H01R 13/6658* (2013.01); *H01R 24/60* (2013.01); *H01R 2107/00* (2013.01)

(58) Field of Classification Search

CPC .... H01R 12/79; H01R 43/205; H01R 12/724; H01R 13/639; H01R 13/6461; H01R 13/6585; H01R 13/6599; H01R 2103/00; H01R 24/38; H01R 43/0207; H01R 4/187; H01R 4/20; H01R 4/625; H01R 11/12

See application file for complete search history.

(56) References Cited

U.S. PATENT DOCUMENTS

| | | | | |
|---|---|---|---|---|
| 8,011,960 | B2 | 9/2011 | Xiao et al. | |
| 8,535,088 | B2 | 9/2013 | Gao et al. | |
| 9,017,092 | B1 | 4/2015 | McCracken et al. | |
| 2005/0181670 | A1* | 8/2005 | Kumamoto | H01R 13/6275 439/358 |
| 2009/0283318 | A1* | 11/2009 | Bonga | H05K 1/0243 174/350 |
| 2010/0093218 | A1* | 4/2010 | Zhang | H01R 13/6583 439/607.45 |

(Continued)

FOREIGN PATENT DOCUMENTS

| | | | | |
|---|---|---|---|---|
| CN | 202856090 | | 4/2013 | |
| JP | 2009218897 | A * | 9/2009 | H01Q 1/526 |

*Primary Examiner* — Truc Nguyen
(74) *Attorney, Agent, or Firm* — Wei Te Chung; Ming Chieh Chang

(57) ABSTRACT

A cable connector assembly (100) adapted for mating with a mating connector includes a connector (200) connected with a cable (300). The connector includes a mating member (1), a metal shell (4) disposed at an outer side of the mating member and the cable, and an outer shell (5) enclosing the metal shell. The metal shell defines an opening (43) adjacent to a soldered portion of the cable soldered with the connector to prevent the soldered portion from shorting with the metal shell.

9 Claims, 8 Drawing Sheets

(56) References Cited

U.S. PATENT DOCUMENTS

| | | | | |
|---|---|---|---|---|
| 2010/0120290 | A1* | 5/2010 | Ko | H01R 13/7175 439/626 |
| 2014/0073193 | A1 | 3/2014 | SooHoo et al. | |
| 2015/0037986 | A1 | 2/2015 | Wu et al. | |
| 2015/0044907 | A1* | 2/2015 | Kuang | H01R 9/038 439/607.22 |
| 2015/0207272 | A1* | 7/2015 | Ning | H01R 13/6594 439/78 |
| 2015/0214670 | A1 | 7/2015 | Di et al. | |
| 2015/0214677 | A1 | 7/2015 | Huang et al. | |
| 2015/0288107 | A1 | 10/2015 | Wu et al. | |
| 2015/0288110 | A1* | 10/2015 | Taniguchi | H01R 13/46 439/620.22 |
| 2015/0364871 | A1* | 12/2015 | Lin | H01R 13/6581 439/607.58 |

* cited by examiner

CABLE CONNECTOR ASSEMBLY HAVING IMPROVED METAL SHELL

BACKGROUND OF THE INVENTION

1. Field of the Invention

The present invention relates to a cable connector assembly, and more particularly to a cable connector assembly having a metal shell.

2. Description of Related Arts

China Patent No. 202856090, issued on Apr. 3, 2013 to Guo et al., discloses a cable connector assembly comprising an insulative housing, a plurality of contacts received in the insulative housing, a metal shell covering the insulative housing, an outer shell over molding with the metal shell, and a cable electrically connected with the contacts and extending beyond the metal shell and the insulative housing. The metal shell comprises a top surface, a bottom surface, a plurality of side surfaces connected with the top surface and the bottom surface, and an extending wall extending upwardly from the bottom to seal a rear portion of the metal shell to improve anti-EMI performance. The fully sealed metal shell, however, is apt to cause an inner soldered portion shorting the metal shell.

Hence, an improved cable connector assembly is desired to offer advantages over the related art.

SUMMARY OF THE INVENTION

An object of the present invention is to provide a cable connector assembly having improved metal shell that is not easy to short with an inner soldered portion.

To achieve the above-mentioned object, a cable connector assembly adapted for mating with a mating connector comprises a connector connected with a cable, the connector comprising: a mating member; a metal shell disposed at an outer side of the mating member and the cable; and an outer shell enclosing the metal shell; wherein the metal shell defines an opening adjacent to a soldered portion of the cable soldered with the connector to prevent the soldered portion shorting with the metal shell.

According to the present invention, the metal shell defines an opening adjacent to a soldered portion of the cable to the connector in order to prevent the soldered portion from shorting with the metal shell.

DETAILED DESCRIPTION OF THE PREFERRED EMBODIMENT

Figure 1:
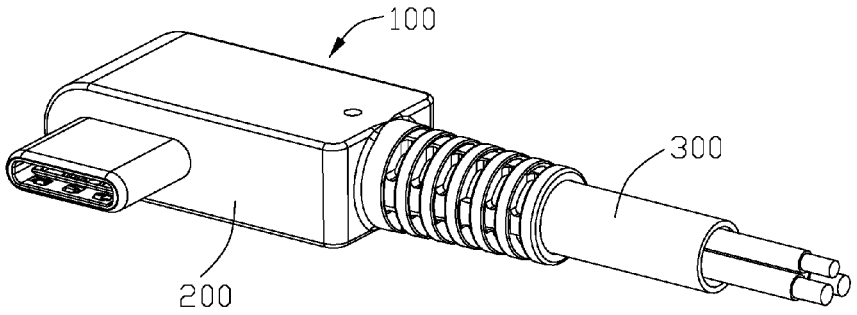
FIG. 1 is a perspective view of a cable connector assembly in accordance with present invention.
Figure 2:
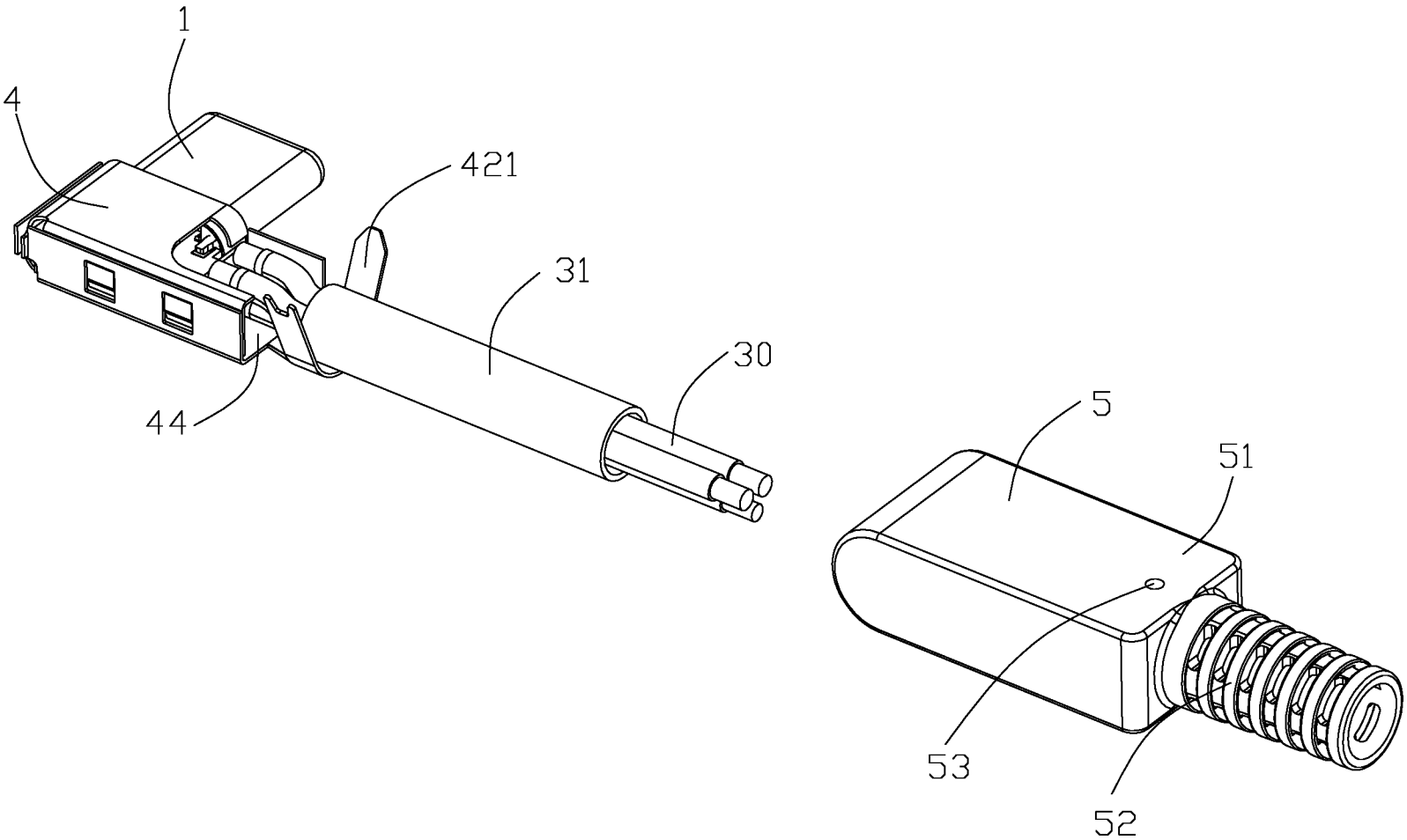
FIG. 2 is a partly exploded view of the cable connector assembly as shown in FIG. 1.
Figure 3:
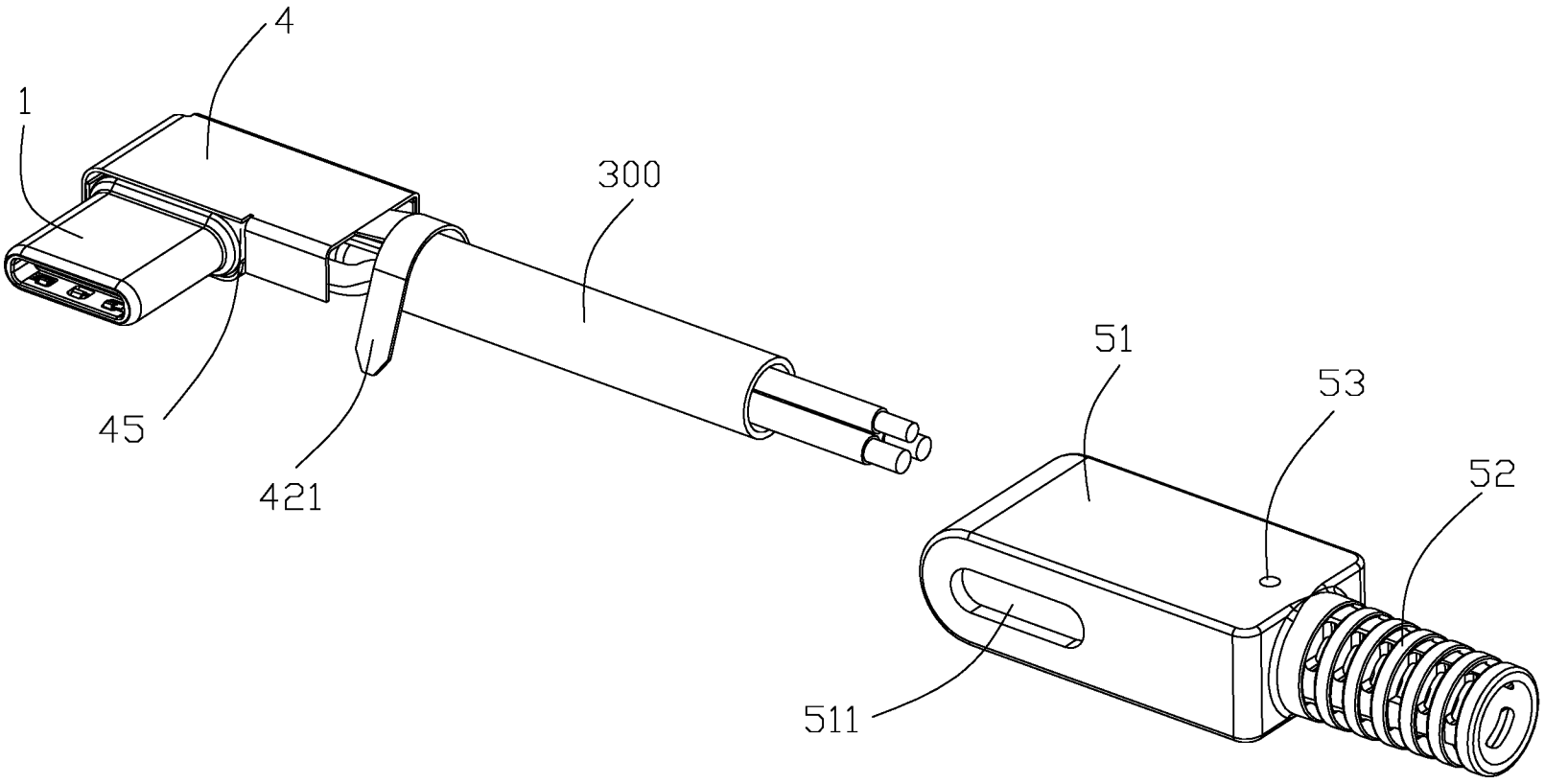
FIG. 3 is another partly exploded view of the cable connector assembly as shown in FIG. 2.
Figure 4:
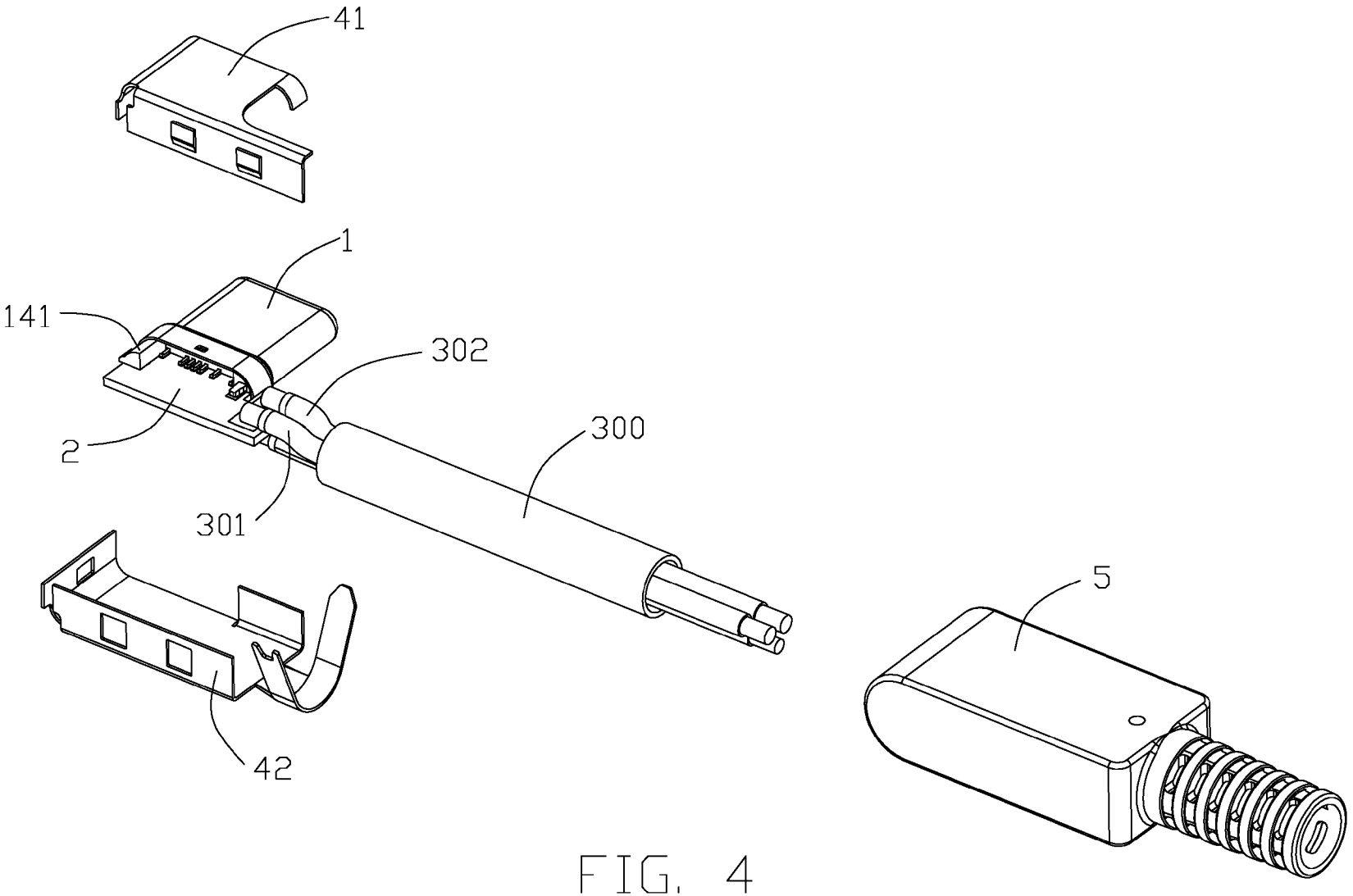
FIG. 4 is a further partly exploded view of the cable connector assembly as shown in FIG. 3.

Reference will now be made in detail to a preferred embodiment of the present invention.

Referring to FIGS. 1 to 4, a cable connector assembly 100 adapted for being mating with a mating connector, comprises a connector 200, and a cable 300 connected with the connector 200. The connector 200 comprises a mating member 1, a printed circuit board 2 electrically connected with the mating member 1, and a metal shell 4 disposed at an outer side of the mating member 1 and the cable 300, and an outer shell 5 enclosing the metal shell 4. The printed circuit board 2 is received in the metal shell 4.

Figure 7:
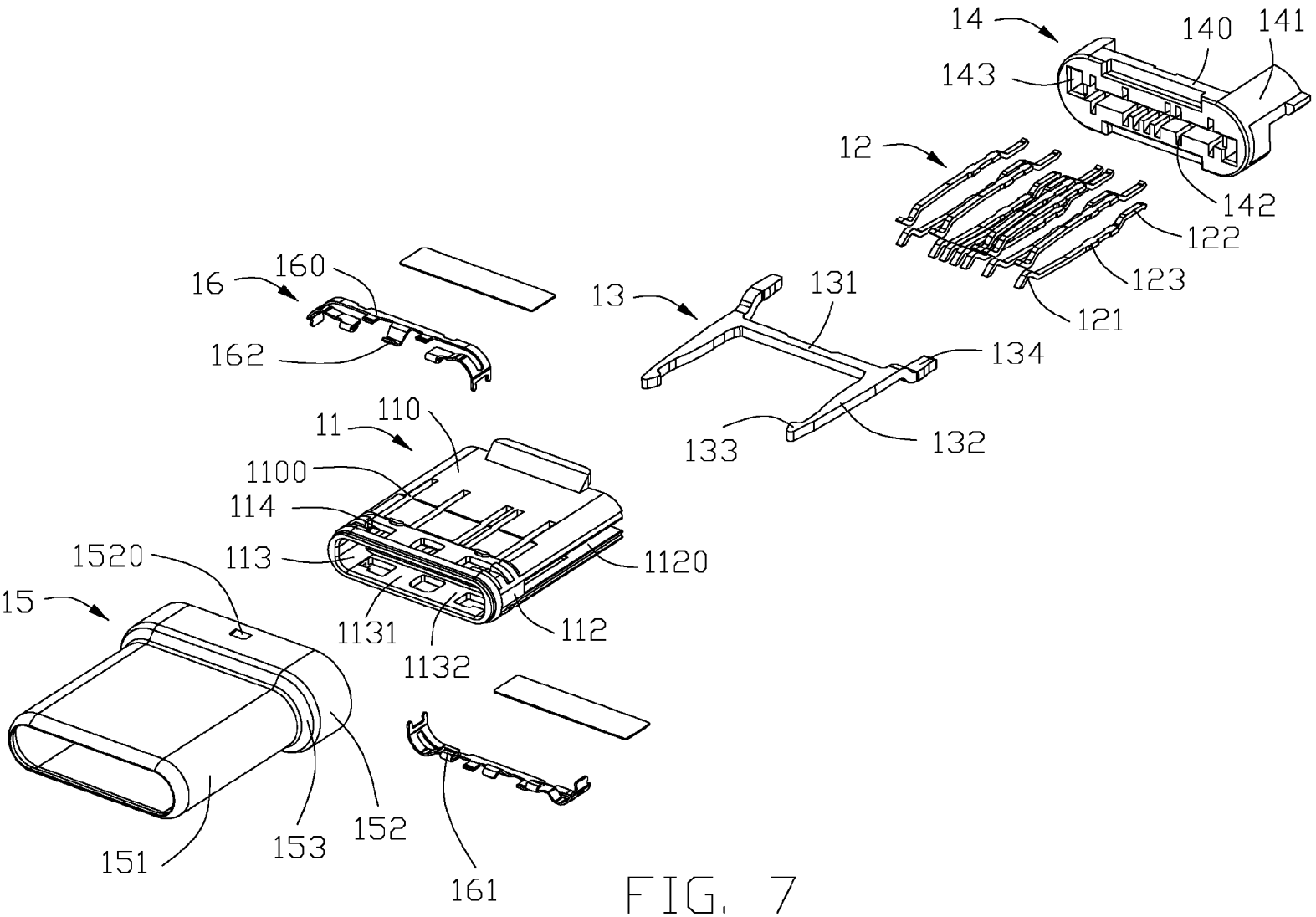
FIG. 7 is an exploded view of the mating member of the cable connector assembly as shown in FIG. 1.
Figure 8:
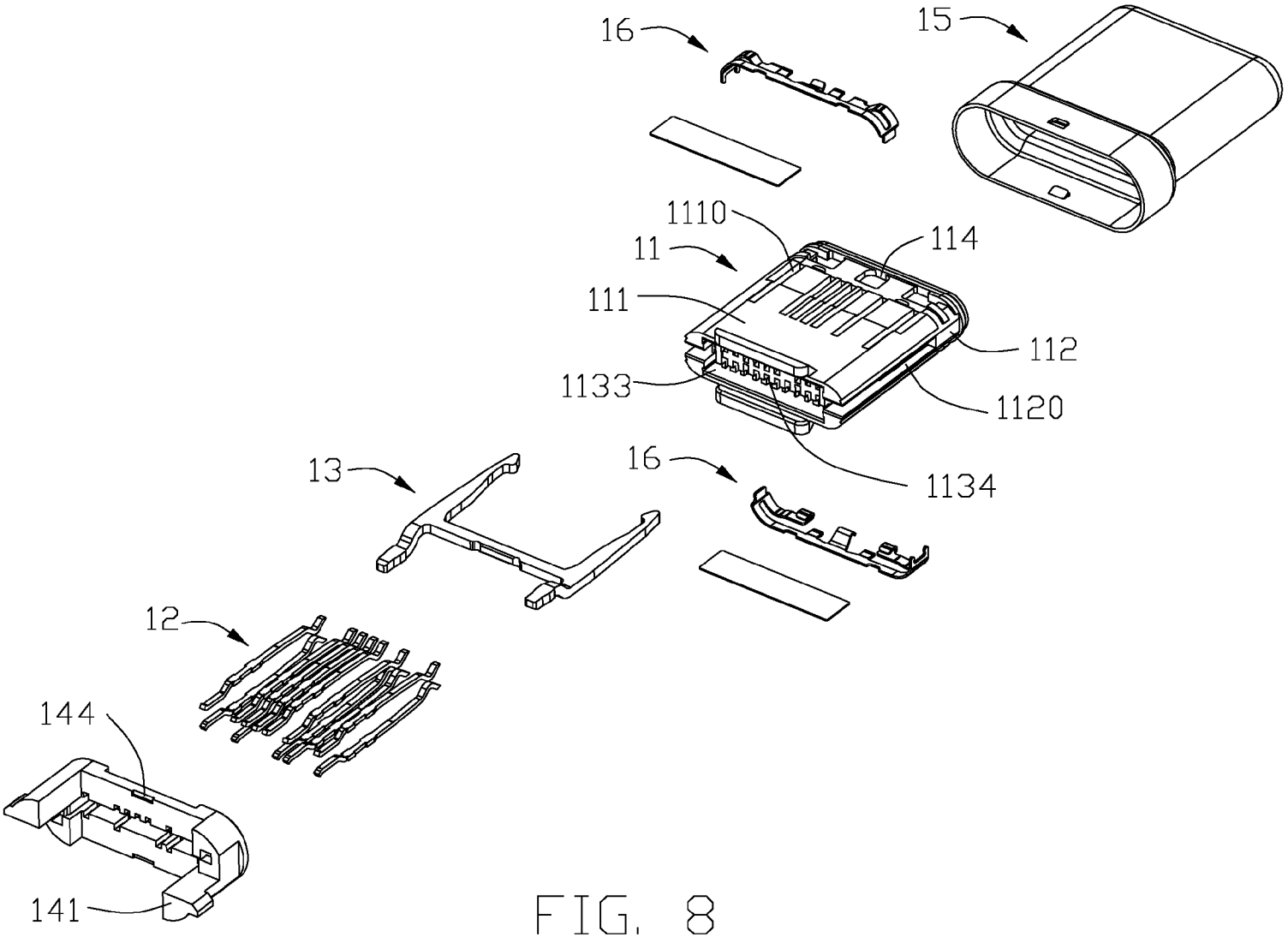
FIG. 8 is another exploded view of the mating member of the cable connector assembly as shown in FIG. 7.

Referring to FIGS. 7 and 8, the mating member 1 comprises an insulative housing 11, a plurality of contacts 12 arranged in two rows and spaced apart from each other in a vertical direction, a latch 13 disposed between the two rows of contacts 12 for latching with the mating connector, an insulative member 14 assembled on a rear end of the insulative housing 11, a mating shell 15 covering the insulative housing 11 and the insulative member 14, and a grounding member 16 assembled on the insulative housing 11 and electrically connected to the mating shell 15.

The insulative housing 11 comprises a top wall 110, a bottom wall 111 spaced apart from and parallel with the top wall 110 in a vertical direction, a pair of side walls 112 parallel to each other and connecting with the top wall 110 and the bottom wall 111, a receiving room 113 surround by the top wall 110, the bottom 111, and the side walls 112. The receiving room 113 is divided into a front portion or mating port 1132 having a front opening 1131 and a rear portion 1134 having a rear opening 1133. The top wall 110 defines a top recess 1100 in communication with the front portion 1132. The bottom wall 111 defines a bottom recess 1110 in communication with the front portion 1132. Each of the side walls 112 defines a side recess 1120 extending forwardly from a rear end of the insulative housing 11 but not through a front end of the insulative housing 11. The side recesses 1120 are in communication with the front portion 1132 and the rear portion 1134 of the receiving room 113. A plurality of slots 114 are defined on a front end of the both top wall and the bottom wall 111.

Each of the contacts 12 comprises, along a front-to-back direction, a front mating portion or contacting section 121 extending forwardly into the insulative housing 11, a rear mating/mounting portion or tail section 122 extending rearwardly, and an intermediate mounting portion 123 connected between the front mating portion 121 and the rear mating portion 122 and secured to the insulative housing 11. The front mating portion 121 is to be mated with the mating connector and the rear mating portion 122 is to be electrically mated with the printed circuit board 2. The front mating portions 121 of the two rows of contacts 12 are arranged face to face along a vertical direction.

The latch 13 comprises a base portion 131 extending along a transverse direction, a pair of latch beams 132 respectively extending forwardly from two opposite ends of the base portion 131, a latch portion 133 extending from a front end of each latch beam 132 along a face to face direction, and a pair of extension arms 134 respectively extending rearwardly from the two opposite ends of the base portion 131. An extension arm 134 on one side is in a lower plane relative to a plane the base portion 131 located, and another extension arm 134 on another side is in a higher plane relative to the plane the base portion 131 located. The latch 13 is mounted into the insulative housing 11 through the rear opening 1133 of the rear portion 1134 of the receiving room 113 along a rear-to-front direction. The latch beams 132 are received into the side recesses 1120, respectively. At least a portion of the latch portions 133 projects into the front portion 1132 of the receiving room 113. The latch portions 133 are arranged face to face along the left-to-right direction.

The insulative member 14 together with the insulative housing 11 fix the latch 13. The insulative member 14 includes a base portion 140 made of insulative material, a pair of extension portions 141 rearwardly extending from a rear end of the base portion 140. The pair of extension portions 141 are offset arranged with each other along a horizontal direction. The base portion 140 defines a plurality of through holes 142 therethrough along a front-to-rear direction and arranged in two rows apart from each other along the vertical direction, to pass through the corresponding contacts 12, and a pair of mounting holes 143 defined on the opposites sides of the base portion 140 to pass through the extension arms 134. Each of the extension portions 141 defines an outward protruding sheet 1410 thereon. The dimension of the base portion 140 along the vertical direction is greater than the dimension of the insulative housing 11, thus when the insulative member 14 is mounted on the insulative housing, the insulative member 14 is exposed to the top wall 110 and bottom wall 111 of the insulative housing 11 along the vertical direction. The insulative member 14 is mounted on the insulative housing 11 along a rear-to-front direction, the extension arms 134 extending into the mounting holes 143, the rear mating portions 122 of the contacts 12 passing through the through holes 142. The base portion 140 defines a stuck slot 144.

The mating shell 15 has a closed circumference that has a good seal performance, a good anti-EMI performance, etc. The closed circumference of the mating shell 15 could be manufactured by drawing a metal piece, bending a metal piece, casting metal materials, etc. The mating shell 15 comprises a first front end 151 for being inserted into the mating connector, a first rear end 152 with a larger size than the first front end 151, and a first transition portion 153 for connecting to the first front end 151 and the first rear end 152. The shape of the first rear end 152 is consistent with the insulative member 14. A diametrical dimension of the first front end 151 is smaller than a diametrical dimension of the first rear end 152. The first rear end 152 comprises a pair of latch tabs 1520 projecting outwardly to engage with the stuck slot 144 of the insulative member 14.

The grounding members 16 is a pair, and mounted on the top wall 110 and the bottom wall 111 of the insulative housing 11 respectively. Each of the grounding members 16 includes a main body 160, a pair of resilient sheets 161 extending towards to the insulative housing 11 from the main body 160 and a grounding sheet 162 forwardly extending from a front end of the main body 160 to be received in the first front portion 1132 of the receiving room 113. The resilient sheets 161 and grounding sheet 162 are received in the corresponding slots 114 of the insulative housing 11 respectively. The grounding sheets 162 are to mate with the mating connector. The pair of grounding sheets 162 of the pair of grounding members 16 is arranged face to face along the vertical direction. The direction between the pair of grounding sheets 162 is greater than the direction between the front mating portions 121 of the upper row of contacts 12 and the front mating portions 121 of the lower row of contacts 12 along the vertical direction.

Figure 5:
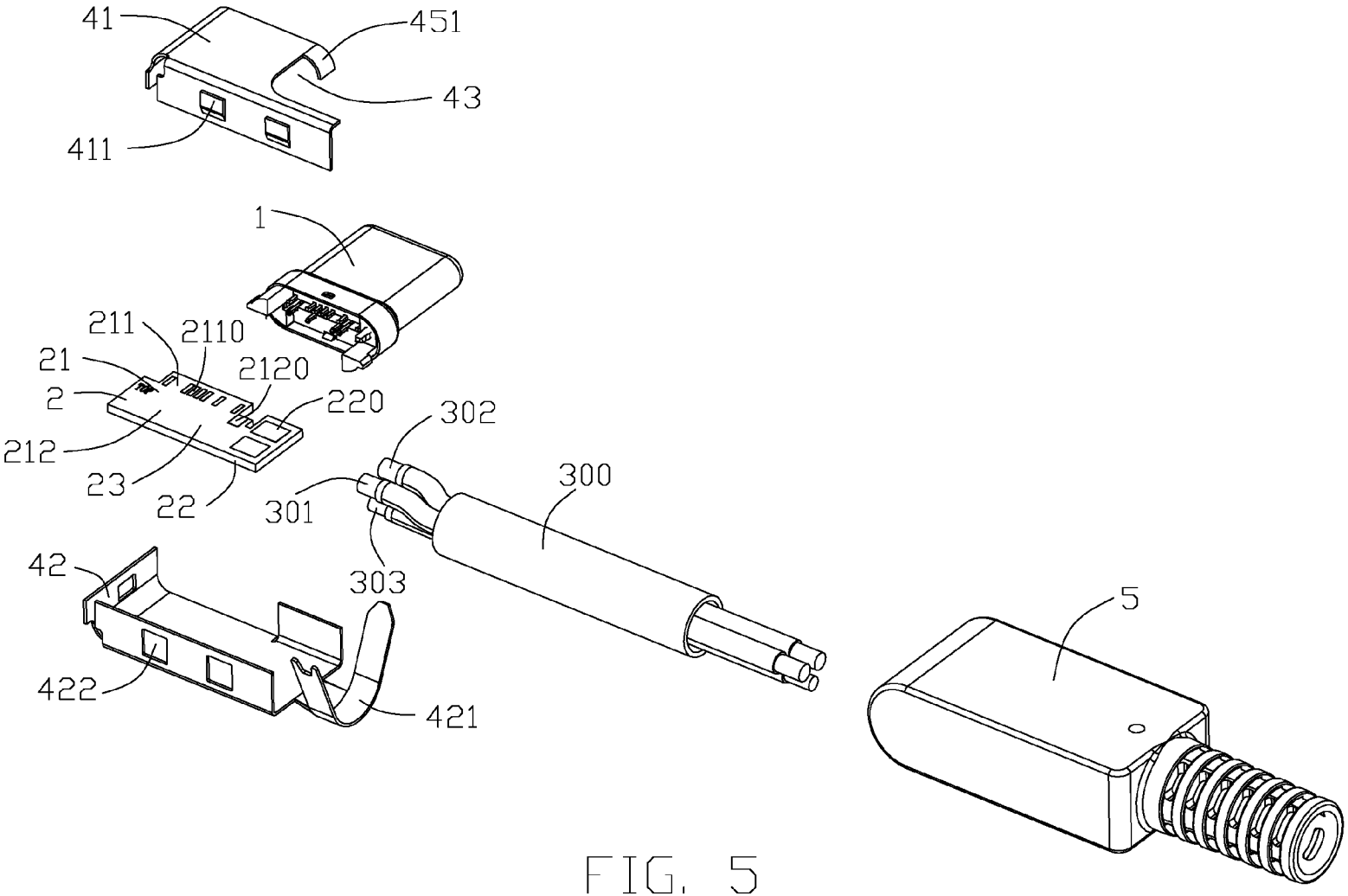
FIG. 5 is a further partly exploded view of the cable connector assembly as shown in FIG. 4.
Figure 6:
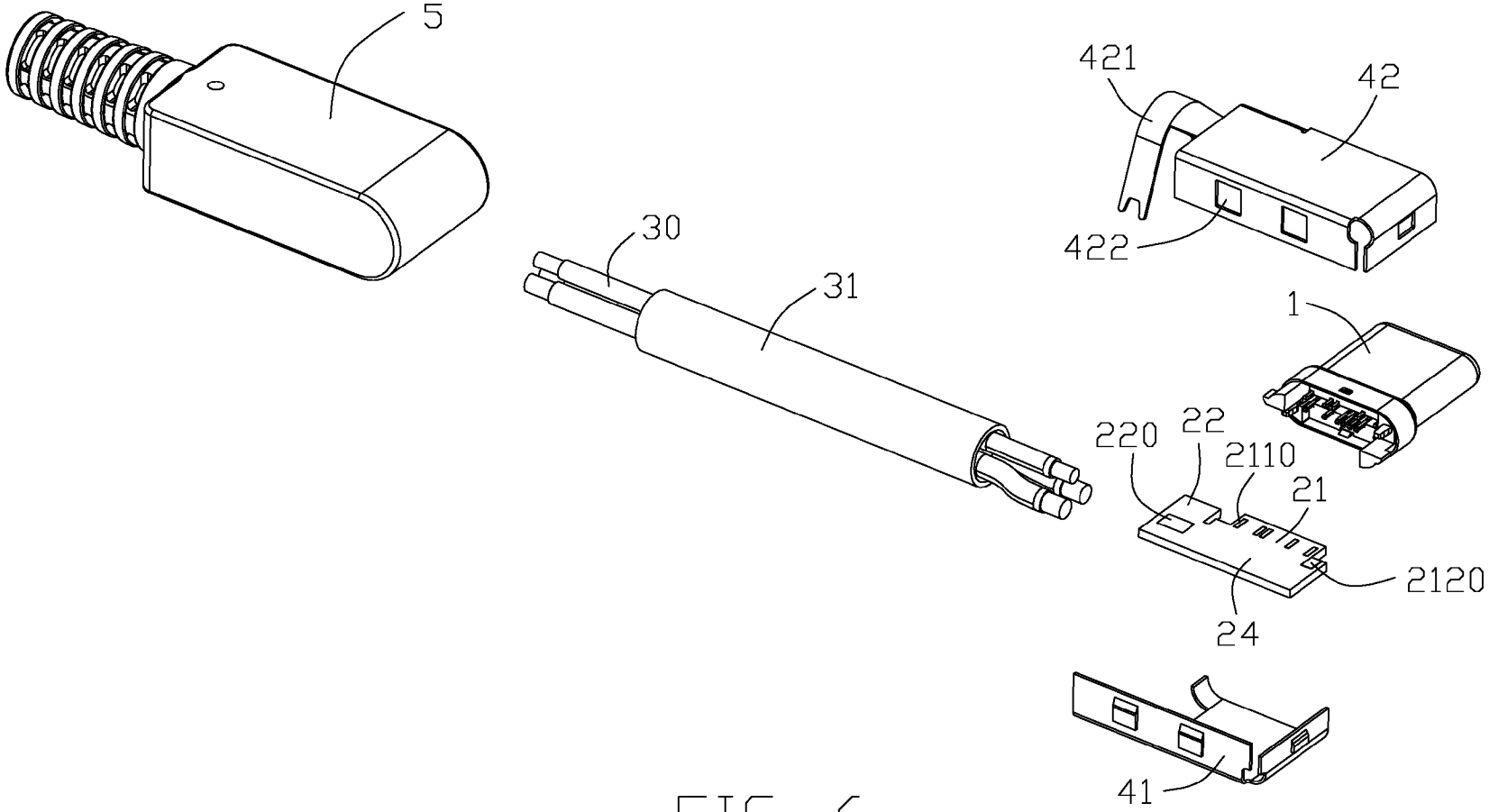
FIG. 6 is another partly exploded view of the cable connector assembly as shown in FIG. 5.

Referring to FIGS. 5 and 6, the printed is disposed between the mating member 1 and the cable 300. The cable 300 is electrically connected with the contacts 12 by the printed circuit board 2. The printed circuit board 2 comprises first portion 21 and a second portion 22. The first portion 21 comprises a front portion 211 and a rear portion 211 larger than the front portion 211. The printed circuit board 2 comprises a top surface 23 and a bottom surface 24 opposite to the top surface 23. Pluralities of first conductive pads 2110 are disposed at the top surface 23 and the bottom surface 24 of the front portion 211 soldered with the rear mating portion 122, respectively. Both of the top surface 23 and the bottom surface 24 adjacent to the front portion 211 comprises a conductive pad 2120 latch with the extension arms of the latch 13 respectively to enhance a retention force of fixing the latch 13. The front portion 211 is disposed between the rear mating portions 122 of the upper row of contacts 12 and the rear mating portions 122 of the lower row of contacts 12 along the vertical direction. Pluralities of second conductive pads 220 are disposed at the top surface 23 and the bottom surface 24 of the second portion 22 soldered with the cable 300. The first conductive pads 2110 are arranged along a direction perpendicular to a direction of the second conductive pads 220 arranged. The pair of extension portions 141 are clipped with the top surface 23 and the bottom surface 24 of the printed circuit board, when the mating member 1 is mounted to the printed circuit board 2.

The cable 300 comprises a plurality of wires 30 and a jacket enclosing the wires 31. The wires 31 comprises a power wire 301 for transmitting power signal, a grounding wire 302 for transmitting grounding signal, and a control wire 303 for transmitting control signal. Both of the power wire 301 and the grounding wire 302 are soldered on the top surface 23. The control wire 303 is soldered on the bottom surface 24. The mating member 1 is disposed at a front portion of the printed circuit board 2, and the cable 300 is disposed at a side of the printed circuit board 2. The mating member 1 extends along a direction perpendicular to a direction of the cable 300 extending.

The metal shell 4 defines an opening 43 adjacent to a soldered portion of the cable 300 soldered with the connector 200 to prevent the soldered portion shorting with the metal shell 4. The metal shell 4 comprises a top shell 41 and a bottom shell 42 mated with the top shell 41. In this embodiment, both of the power wire 301 and the grounding wire 302 are soldered on the top surface 23. Therefore, the opening is defined on the top shell 41. The soldered portions of the power wire 301 and the grounding wire 302 are exposed to an outer side of the metal shell through the opening 43 of the metal shell 4. The bottom shell 42 comprises a crimping portion 421 to crimp with the cable 300. The top shell 41 comprises a pair of spring tabs 411 disposed at a side portion. The bottom shell 42 defines a pair of latching holes 422 latched with the spring tabs 411, respectively. The top shell 41 and the bottom shell 42 cooperate to define a mounting hole 44 for the cable 300 extending out the metal shell 4, the opening 43 being in communication with the mounting hole 44. The top shell 41 and the bottom shell 42 cooperate to define a front mounting hole 45 for the mating member 1 extending out the metal shell 4. The metal shell 4 comprises at least one curved spring tab 451 located beside the opening 43 and being curvedly consistent with and compliantly contacting the first rear end 152 of the mating shell 15. The first rear end 152 is clipped by the spring tab 451. The first rear end 152 of the mating shell 15 is received in the metal shell 4 and soldered with the metal shell 4 by laser welding or multi spot welding or whole week continuous welding.

The outer shell 5 is over molding with the metal shell 4 and over molding with the soldering portions of the power wire 301 and the grounding wire 302 of the cable 300 soldered with the printed circuit board 2 of the connector 200. The outer shell 5 comprises a receiving portion for receiving the first rear end 152 of the mating member 15 and the metal shell 4, and a strain relief portion 52 for the cable 300 passing through. The receiving portion 51 defines a through hole 511 for the mating member 1 passing through. The outer shell 5 defines a pair of locating holes 53 formed by support members for supporting the metal shell 4 been removed. In brief, in this embodiment, the printed circuit board forms a long side along the longitudinal direction and a short side along a transverse direction perpendicular to the longitudinal direction with on one side a contact soldering area (not labeled) for soldering with the contacts and a wire soldering area (not labeled) for soldering with the wires with a cutout (not labeled) therebetween in the longitudinal direction wherein the mating member faces to an exterior in the transverse direction. Notably, in this embodiment a root of one extension portion 141 is received within the cutout, and the cable 300 extends along the longitudinal direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical cable connector assembly comprising:

a printed circuit board having defining a long side along a longitudinal direction, and a short side along a transverse direction perpendicular to said longitudinal direction, and a contact soldering area and a wire soldering area spaced from each other along the longitudinal direction with a cutout therebewtween;

an electrical connector located by one long side of the printed circuit board and including:

an insulative housing defining a mating port extending toward an exterior in the transverse direction;

a metallic shield enclosing said insulative housing;

a plurality of contacts disposed in the housing, each of said contacts including a front contacting section exposed in the mating port and a rear tail section soldered upon the contact soldering area;

the housing defining two opposite extension portions in the longitudinal direction on a rear side, one of said extension portions received within the cutout;

a cable including a plurality of wires soldered upon the wire soldering area and extending along the longitudinal direction;

a metallic shell enclosing the printed circuit board, a rear portion of the metallic shield and a front portion of the cable;

an insulative outer shell enclosing said metallic shell and a portion of the cable behind the metallic shell in said longitudinal direction; wherein said metallic shell forms an opening aligned with said wire soldering area in a vertical direction perpendicular to both said longitudinal direction and said transverse direction, so as to eliminate a risk of shorting between the wires and the metallic shell.

2. The electrical cable connector assembly as claimed in claim 1, wherein the connector includes a metallic latch with a pair of extension arms of which one is soldering upon the printed circuit board behind the cutout in said transverse direction.

3. The electrical cable connector assembly as claimed in claim 1, wherein the contact soldering area is located between the pair of extension portions.

4. The electrical cable connector assembly as claimed in claim 1, wherein the wire soldering area is not aligned with the housing in said transverse direction.

5. The electrical cable connector assembly as claimed in claim 1, wherein said metallic shell includes opposite two parts assembled to each other in the vertical direction, and the opening is formed only one of said two parts.

6. The electrical cable connector assembly as claimed in claim 5, wherein the wire soldering area is formed on two opposite surfaces of the printed circuit board, and the opening is formed corresponding to the soldering area connecting to a power wire on one of said opposite surfaces while the other part covers the solder area connecting to a signal wire on the other of said opposite surfaces.

7. An electrical cable connector assembly comprising:

a mating member including:

an insulative housing defining a mating port extending to an exterior in a transverse direction;

a plurality of contacts dispose in insulative housing, each of said contacts including a front contacting section exposed in the mating port, and a rear tail section;

a printed circuit board located behind the mating member in the transverse direction, and including a contacting soldering area on which the tail sections are soldered, and a wire soldering area located beside the contact soldering area in a longitudinal direction perpendicular to said transverse direction;

a cable including a plurality of wires with corresponding ends soldered upon the wire soldering area;

a metallic shell enclosing said printed circuit board, a rear portion of the mating member and a front portion of the cable; and an insulative outer shell enclosing said metallic shell; wherein said metallic shell forms an opening aligned, in a vertical direction perpendicular to both said transverse direction and said longitudinal direction, with the wire soldering area on which the specific wire transmitting power is soldered, so as to eliminate a risk of shorting between the specific wire and the metallic shell; and the printed circuit board forms a cutout between the contact soldering area and the wire soldering area to receive a root of an extension portion on a rear side of the housing.

8. The electrical cable connector assembly as claimed in claim 7, wherein said cable extends along the longitudinal direction.

9. An electrical cable connector assembly comprising:

a mating member including:

an insulative housing defining a mating port extending to an exterior in a transverse direction;

a metallic mating shell enclosing said insulative housing and defining a rear end;

a plurality of contacts dispose in insulative housing, each of said contacts including a front contacting section exposed in the mating port, and a rear tail section;

a printed circuit board located behind the mating member in the transverse direction, and including a contacting soldering area on which the tail sections are soldered, and a wire soldering area located beside the contact soldering area in a longitudinal direction perpendicular to said transverse direction;

a cable including a plurality of wires with corresponding ends soldered upon the wire soldering area;

a metallic shell enclosing said printed circuit board, a rear portion of the mating member and a front portion of the cable; and an insulative outer shell enclosing said metallic shell; wherein said metallic shell forms an opening aligned, in a vertical direction perpendicular to both said transverse direction and said longitudinal direction, with the wire soldering area on which the specific wire transmitting power is soldered, so as to eliminate a risk of shorting between the specific wire and the metallic shell; wherein the metallic shell includes a top shell and a bottom shell assembled with each other in the vertical direction, the opening is formed in the top shell, and the printed circuit board is enclosed in the bottom shell while being exposed outside of the top shell via said opening; wherein the top shell cooperates with the bottom shell to commonly define a front mounting hole through which the mating member extends in the transverse direction, and said top shell further includes a curved spring tab located beside the opening and compliantly contacting the rear end of the mating shell.

* * * * *